US008903274B2

(12) United States Patent
Ju et al.

(10) Patent No.: US 8,903,274 B2
(45) Date of Patent: Dec. 2, 2014

(54) IMAGE FORMING APPARATUS

(71) Applicant: Samsung Electronics Co., Ltd., Suwon-si (KR)

(72) Inventors: Jeong Yong Ju, Suwon-Si (KR); Byeong Hwa Ahn, Seongnam-si (KR); Jun Ho Lee, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 61 days.

(21) Appl. No.: 13/661,506

(22) Filed: Oct. 26, 2012

(65) Prior Publication Data

US 2013/0108320 A1 May 2, 2013

(30) Foreign Application Priority Data

Oct. 26, 2011 (KR) ..... 10-2011-0110062
Oct. 22, 2012 (KR) ..... 10-2012-0117157

(51) Int. Cl.
*G03G 15/16* (2006.01)
*G03G 21/16* (2006.01)
*G03G 15/01* (2006.01)

(52) U.S. Cl.
CPC .... *G03G 21/1633* (2013.01); *G03G 2215/0132* (2013.01); *G03G 21/1638* (2013.01); *G03G 2215/00544* (2013.01); *G03G 15/0189* (2013.01)
USPC ..... 399/121; 399/110

(58) Field of Classification Search
None
See application file for complete search history.

(56) References Cited

U.S. PATENT DOCUMENTS

2011/0091238 A1* 4/2011 Nakazawa ..... 399/110
2012/0099896 A1* 4/2012 Kamano ..... 399/121

* cited by examiner

*Primary Examiner* — Clayton E Laballe
*Assistant Examiner* — Jas Sanghera
(74) *Attorney, Agent, or Firm* — Staas & Halsey LLP

(57) ABSTRACT

An image forming apparatus including a side cover rotatably installed to open and close an opening provided at a body thereof while rotating, a first transfer unit to which a visible image of photoconductors of developing units is transferred, and a second transfer unit movably installed at the side cover to transfer the visible image to a printing medium, wherein the second transfer unit is provided at both sides thereof with a plurality of guide protrusions to perform a position restriction, and the body is provided at both sidewalls of inside thereof with a plurality of guide members to support the plurality of guide protrusions such that the second transfer unit is supported against both sidewalls of the inside of the body through the guide protrusion and the guide member, thereby reducing a reaction force applied to the side cover.

14 Claims, 10 Drawing Sheets

IMAGE FORMING APPARATUS

This application claims the benefit of Korean Patent Applications No. 2011-0110062, filed on Oct. 26, 2011 and Korean Patent Applications No. 2012-0117157, filed on Oct. 22, 2012 in the Korean Intellectual Property Office, the disclosure of which is incorporated herein by reference.

BACKGROUND

1. Field

Embodiments of the present disclosure relate to an image forming apparatus having a transfer apparatus configured to transfer a toner from a plurality of developing units to a printing sheet.

2. Description of the Related Art

In general, an image forming apparatus is designed to form an image on a printing medium, and includes a printer, a copy machine, a facsimile, and a multifunctional device incorporating the functionalities of the printer, the copy machine, and the facsimile.

The image forming apparatus includes a body having an opening at one side thereof and a side cover rotatably installed at the body to open/close the opening. At an inside of the body, a plurality of developing units to develop an electrostatic latent image to a visible image through toners by colors, an exposure apparatus to scan light to the photoconductors of the plurality of developing units to form an electrostatic latent image on the photoconductor, a transfer apparatus to transfer a visible image developed on the photoconductor to a printing medium, and a fixing apparatus to fix the toner to the printing medium, are included.

In the structure as such, the transfer apparatus includes a first transfer unit disposed at an inside the body and a second transfer unit disposed at the side cover.

The first transfer unit includes a transfer belt to which the visible image developed on the photoconductors is transferred, a driving roller and a driven roller disposed at both sides of the inside the transfer belt, and a first transfer roller enabling the visible image of the photoconductor to be transferred to the transfer belt. The second transfer unit includes a second transfer roller enabling the visible image of the transfer belt to be transferred to a printing medium.

Accordingly, when the opening is closed by the side cover, the second transfer unit is accommodated at the inside the body, and thus the second transfer roller is pressed by the driving roller.

SUMMARY

Therefore, it is an aspect of the present disclosure to provide an image forming apparatus capable of stably supporting a transfer apparatus.

Additional aspects of the disclosure will be set forth in part in the description which follows and, in part, will be obvious from the description, or may be learned by practice of the disclosure.

In accordance with one aspect of the present disclosure, an image forming apparatus includes a body, a side cover, a plurality of developing units, a first transfer unit, and a second transfer unit. The body may have an opening at one side thereof. The side cover may be rotatably installed to open and close the opening while rotating. The plurality of developing units may each include a photoconductor to develop an electrostatic latent image to a visible image through a toner. The first transfer unit may be disposed at an inside the body such that the visible image of the photoconductor is transferred to the first transfer unit. The second transfer unit may be movably installed at the side cover to transfer the visible image of the first transfer unit to a printing medium. The second transfer unit may include a plurality of guide protrusions provided at both sides of the second transfer unit to perform a position restriction. The body may include a plurality of guide members provided at both sidewalls at the inside the body to support the plurality of guide protrusions installed at the second transfer unit, so that a force transferred from the first transfer unit to the second transfer unit is prevented from being transferred to the side cover.

The first transfer unit comprises a transfer belt to be supplied with a toner from the plurality of developing units, a plurality of first transfer rollers each disposed opposite to the photoconductor while interposing the transfer belt therebetween, and a driving roller and a driven roller disposed at both sides of an inside the transfer belt, respectively. The second transfer unit includes a second transfer roller disposed opposite the driving roller while interposing the transfer belt therebetween, and the guide member may guide the guide protrusion such that the second transfer roller is pressed against the driving roller while interposing the transfer belt therebetween.

The guide member may include a support portion at which the guide protrusion is supported in an engagement manner, and a guide portion to guide the guide protrusion to the support portion.

The guide protrusion may include a first guide protrusion disposed at an upper side of the second transfer unit, and a second guide protrusion disposed at a lower side of the second transfer unit, and the guide member may include a first guide member disposed at an upper side of the both sidewalls of the inside the body, and a second guide member disposed at a lower side of the both sidewalls of the inside the body.

The side cover may include a pair of guide brackets disposed at both sides of the second transfer unit, respectively, such that the second transfer unit is movably installed, a pair of second guide protrusions among the plurality of guide protrusions each has an outer end extending toward lateral sides of the side cover and guided by the second guide member, and an inner end extending toward the guide bracket, and The pair of guide brackets each may include a guide hole to which the inner end of the second guide protrusion is movably installed.

The image forming apparatus may further include a movable spring allowing the second transfer unit to be elastically supported against the side cover.

The second transfer unit may include a rotation bracket, to which the second transfer roller is rotatably installed so as to rotate on a position deviated from a center of rotation of the second transfer roller, and a rotation spring elastically supporting the rotation bracket.

The second transfer unit may include a pair of hinge members rotatably supporting both ends of a shaft of the second transfer roller, a pair of moving guides installed at both sides of the rotation bracket, respectively, such that the hinge member is movable toward the driving roller, and a moving spring allowing the hinge member to be elastically supported against the moving guide. The second transfer roller may be installed at the rotation bracket through the hinge member and the moving guide.

The first transfer unit may include a transfer belt frame at which both end portions of each of the plurality of first transfer rollers, both end portions of the driving roller, and both end portions of the driven roller are rotatably installed. Bearings may be installed at both end portions of the shaft of the second transfer roller, respectively. A restriction groove may be formed at the transfer belt frame to restrict a position of the bearing.

The restriction groove may be provided in a shape of V.

In accordance with another aspect of the present disclosure, an image forming apparatus includes a body, a side cover, a plurality of developing units, a first transfer unit, and a second transfer unit. The body may have an opening. The side cover may be configured to open and close the opening. The plurality of developing units each may include a photoconductor to develop an electrostatic latent image to a visible image through a toner. The first transfer unit may be disposed at an inside the body such that the visible image of the photoconductor is transferred to the first transfer unit. The second transfer unit may be installed at the side cover to transfer the visible image of the first transfer unit to a printing medium. The second transfer unit may include a plurality of guide protrusions provided at both sides of the second transfer unit to perform a position restriction, and the body may include a plurality of guide members provided at both sidewalls of the inside the body to support the plurality of guide protrusions.

The second transfer unit may be movably installed at the side cover.

The second transfer unit may further include a moving spring allowing the second transfer unit to be elastically supported against the side cover.

The guide member may include a support portion at which the guide protrusion is supported in an engagement manner, and a guide portion to guide the guide protrusion to the support portion.

As described above, in a state that the side cover covers the opening, the second transfer unit disposed at the side cover is supported by both sidewalls of the inside the body through the guide protrusions provided at both sides of the second transfer unit and the guide member, so that the force applied to the side cover is reduced.

In addition, the second transfer roller is configured to be rotatable with respect to the side cover, so that the guide protrusion is easily separated from the guide member.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
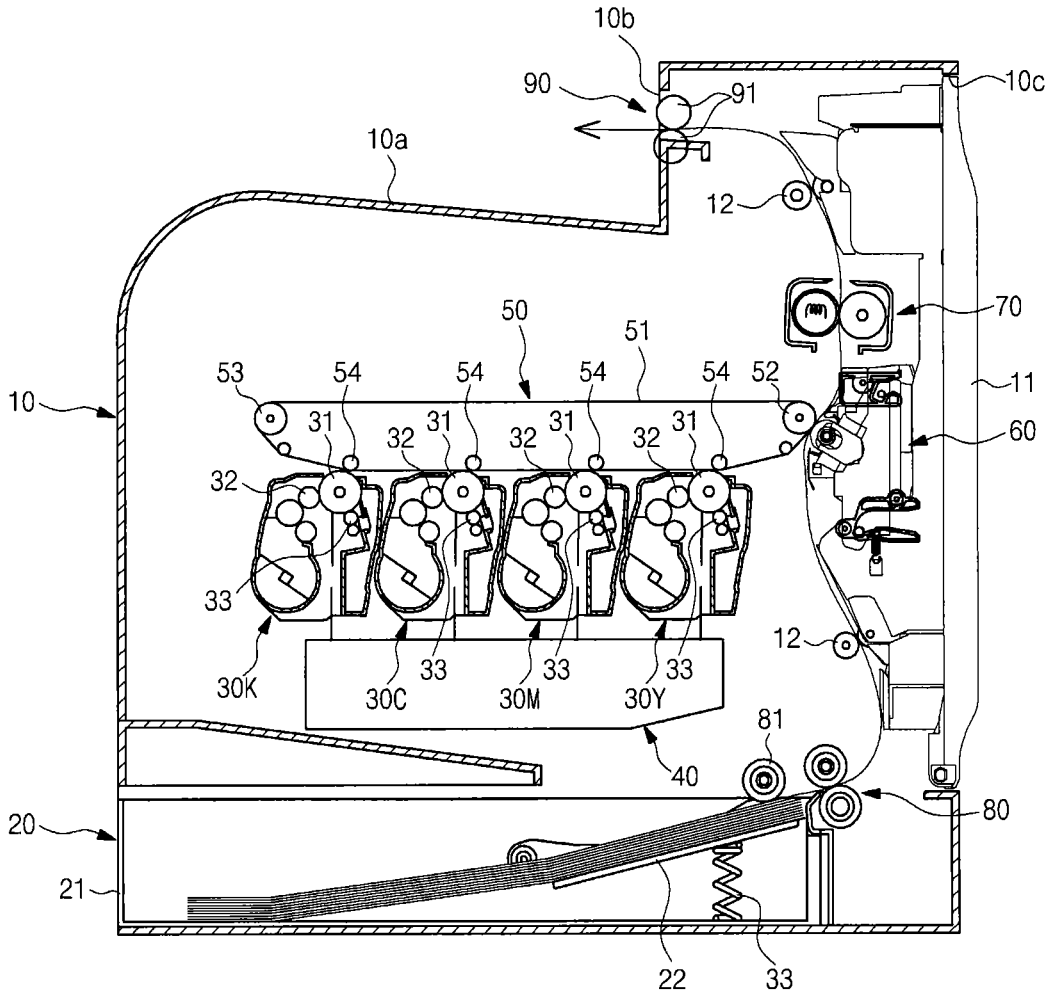
FIG. 1 is a cross-sectional view illustrating an image forming apparatus in accordance with one embodiment of the present disclosure.

Reference will now be made in detail to the embodiments of the present disclosure, examples of which are illustrated in the accompanying drawings, wherein like reference numerals refer to like elements throughout.

An image forming apparatus in accordance with one embodiment of the present disclosure includes a body 10 forming the external appearance of the image forming apparatus, a printing medium storage unit 20 to store a printing medium, a plurality of developing units 30C, 30M, 30Y, and 30K to develop a visible image from an electrostatic latent image according to colors through a toner, an exposure unit 40 to form an electrostatic latent image by scanning light to a photoconductor 31 of each of the developing units 30C, 30M, 30Y, and 30K charged, transfer apparatuses 50 and 60 to transfer the visible image formed on the photoconductor 31 by receiving a printing medium from the printing medium storage unit 20, and a fixing unit 70 to fix a toner, which is transferred to the printing medium, to the printing medium.

The body 10 is provided at an upper portion thereof with a loading unit 10*a* on which the printing medium, having completed with the image forming, is loaded, and a discharge hole 10*b* is provided at one side of the loading unit 10*a* to discharge the printing medium, having completed with the image forming. In addition, the body 10 is provided at one side thereof with an opening 10*c* for a maintenance or replacement of components of the inside the body 10 or for an exchange of the expendable suppliers. A side cover 11 is installed to open/close the opening 10*c*. The side cover 11 in accordance with the embodiment of the present disclosure has a lower end thereof rotatably installed at the body 10 such that the side cover 10 opens/closes the opening 10*c* while rotating on the lower end thereof.

The printing medium storage unit 20 includes a printing medium cassette 21 movably installed at the body 10, a knock-up plate 22 which is disposed at the printing medium cassette 21 and on which the printing medium is loaded, and an elastic member 23 elastically supporting the knock-up plate 22.

Each of the developing units 30C, 30M, 30Y, and 30K includes the photoconductor 31 having a charged surface on which an electrostatic latent image is formed by the exposure unit 40, a developing roller 32 to supply the photoconductor 31 with a toner, and a charge unit 33 to charge a surface of the photoconductor 31.

The developing units 30C, 30M, 30Y, and 30K are composed by including four developing units 30C, 30M, 30Y and 30K to store a cyan (C) toner, a magenta (M) toner, a yellow (Y) toner and a black (K) toner, respectively, and develop a cyan (C) color, a magenta (M) color, a yellow (Y) color and a black (K) color, respectively. The four developing units 30C, 30M, 30Y, and 30K are disposed side by side at a lower side of the transfer apparatuses 50 and 60.

The exposure unit 40 exposes a light that includes image information to the photoconductors 31 provided on the developing units 30C, 30M, 30Y, and 30K, thereby forming an electrostatic latent image on the surface of the photoconductors 31.

The transfer apparatuses 50 and 60 include a first transfer unit 50 on which a visible image formed by a toner is transferred from the developing units 30Y, 30M, 30Y, and 30K, and a second transfer unit 60 to transfer the visible image of the first transfer unit 50 to a printing medium.

The fixing unit 70 includes a heating roller 71 to generate heat and a pressure roller 72 having an outer surface that is formed of elastic deformable material to press the printing medium against an outer surface of the heating roller 71.

In addition, the body 10 is provided with a pick-up unit 80 disposed at an upper portion of the printing medium storage unit 20 to pick up the printing medium loaded on the knock-up plate 22 one by one, transfer rollers 12 to guide the printing medium picked up by the pick-up unit 80 to an upper side, and a discharging unit 90 disposed at an upper side of the fixing unit 70 while adjacent to the discharge hole 10*b* such that the printing medium passing through the fixing unit 70 is discharged through the discharge hole 10*b*. The pick-up unit 80 includes a pick-up roller 81 configured to pick up the printing medium one by one, and the discharging unit 90 includes a pair of discharge rollers 91 disposed at an inner side of the discharge hole 10*b*.

In the structure of the image forming apparatus as such, the first transfer unit 50 includes a transfer belt 51 which is disposed at an inside of the body 10 and to which the toners developed on the photoconductors 31 of the developing units 30C, 30M, 30Y, and 30K in the form of a visible image are transferred in an overlap manner, a driving roller 52 and a driven roller 53 disposed at both sides of the transfer belt 51, respectively, to rotate the transfer belt 51, a plurality of transfer rollers 54 disposed opposite to the photoconductors 31 of the developing units 30C, 30M, 30Y, and 30K while interposing the transfer belt 51 therebetween to transfer the visible image formed on the photoconductors 31 to the transfer belt 51, and a transfer belt frame (55 in FIG. 3) to have both end potions of the plurality of first transfer rollers 54, both end portions of the driving roller 52, and both end portions of the driven roller 53 rotatably installed thereat.

Figure 2:
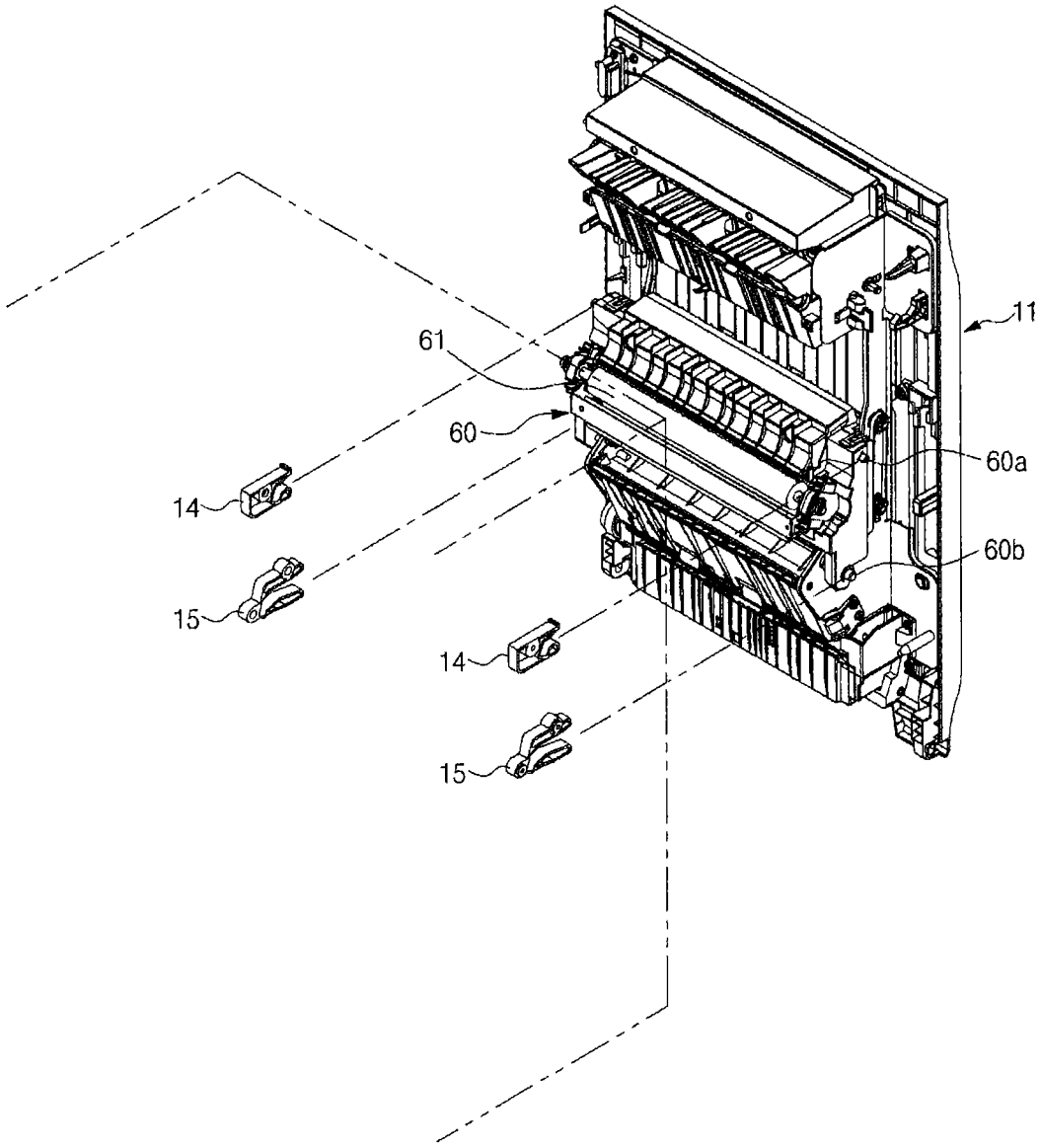
FIG. 2 is a side view showing an operation of opening/closing a side cover applied to the image forming apparatus in accordance with the embodiment of the present disclosure.
Figure 3:
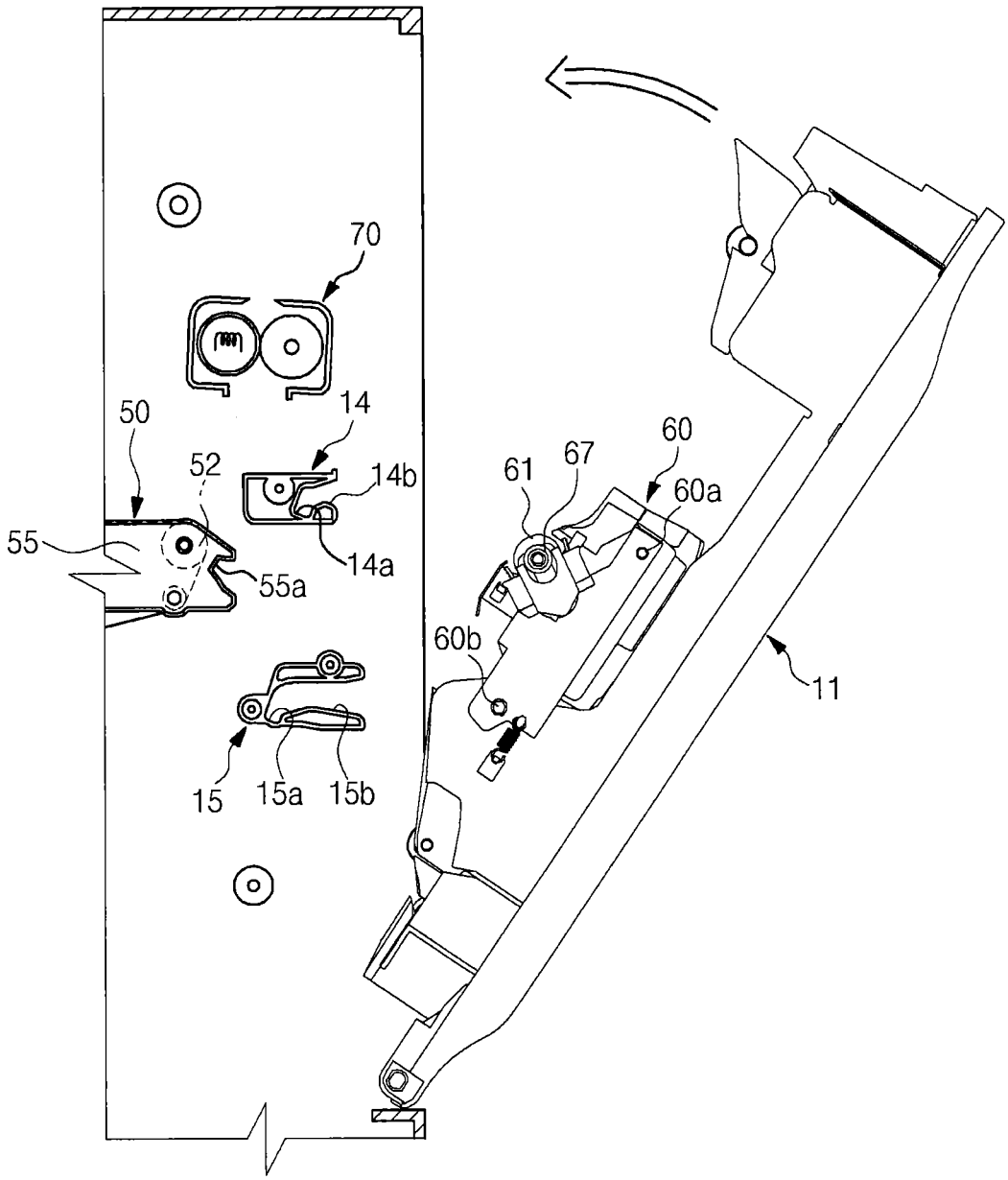
FIG. 3 is a perspective view illustrating a side cover of the image forming apparatus in accordance with the embodiment of the present disclosure.
Figure 4:
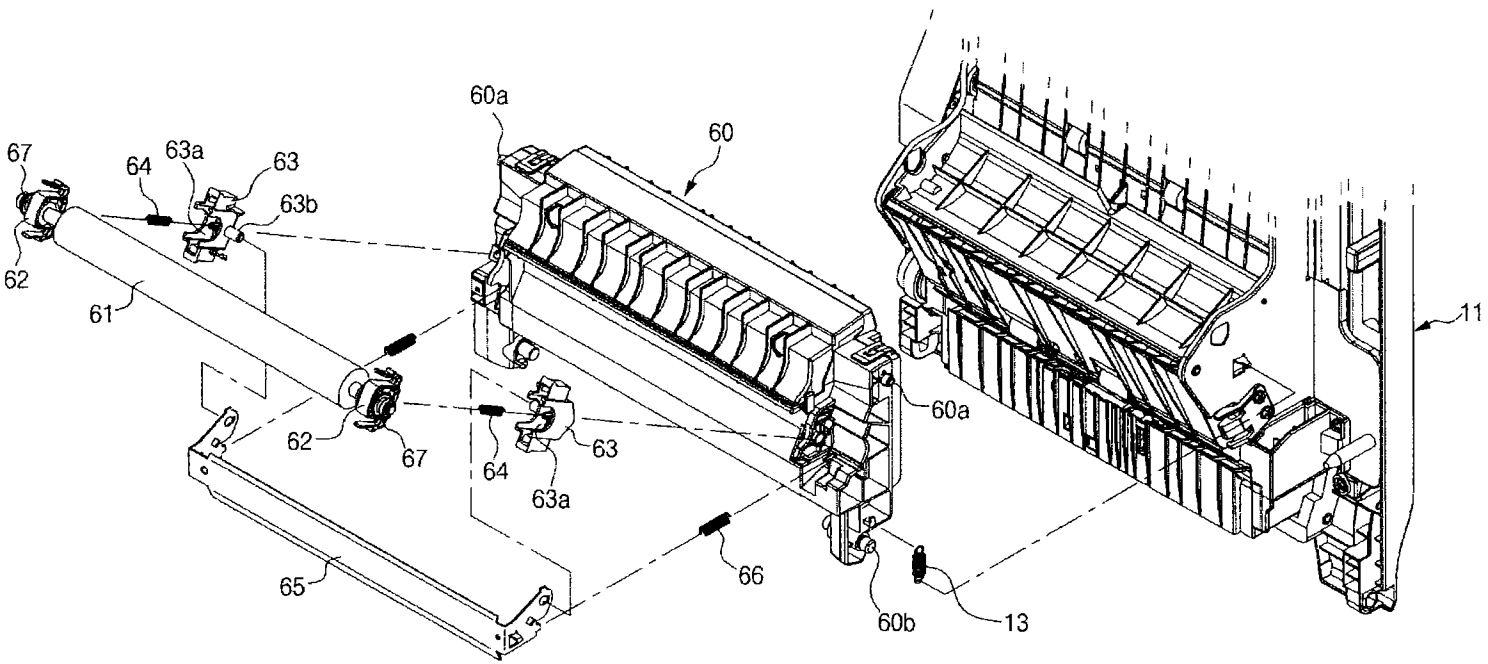
FIG. 4 is an exploded perspective view illustrating a side cover of the image forming apparatus in accordance with the embodiment of the present disclosure.

Referring to FIG. 2, the second transfer unit 60 is installed at the side cover 11, and as the side cover 11 closes the opening 10*c* while rotating, the second transfer unit 60 is accommodated in the inside the body 10. In addition, the second transfer unit 60 is movably installed at the side cover 11, and is elastically supported at the side cover 11 by a moving spring 13 which has one end installed at the second transfer unit 60 while the other end installed at the side cover 11. Referring to FIGS. 3 and 4, the second transfer unit 60, as the side cover 11 closes the opening 10*c*, is moved while being restricted in position by guide protrusions 60*a* and 60*b* and by guide members 14 and 15, which will be described later, so that a second transfer roller 61 of the second transfer unit 60 is precisely pressed against the driving roller 52.

The guide protrusions 60*a* and 60*b* in accordance with the embodiment of the present disclosure include a first guide protrusion 60*a* provided at an upper portion of the second transfer unit 60 and a second guide protrusion 60*b* disposed at a lower portion of the second transfer unit 60. The guide members 14 and 15 in accordance with the embodiment of the present disclosure include a first guide member 14 disposed at an upper portion of both sidewalls of the inside the body 10 to guide the first guide protrusion 60*a*, and a second guide member 15 disposed at a lower portion of both sidewalls of the inside of the body 10 to guide the second guide protrusion 60*b*. In the embodiment of the present disclosure, two second guide protrusions 60*b* each includes an outer end extending toward a lateral side of the second transfer unit 60, and an inner end protruding toward the guide bracket 11*a*, which will be described later. The outer end of the second guide protrusion 60*b* is guided by the second guide member 15, and the inner end of the second guide protrusion 60*b* is inserted into a guide hole 11*b*, which will be described later.

Figure 5:
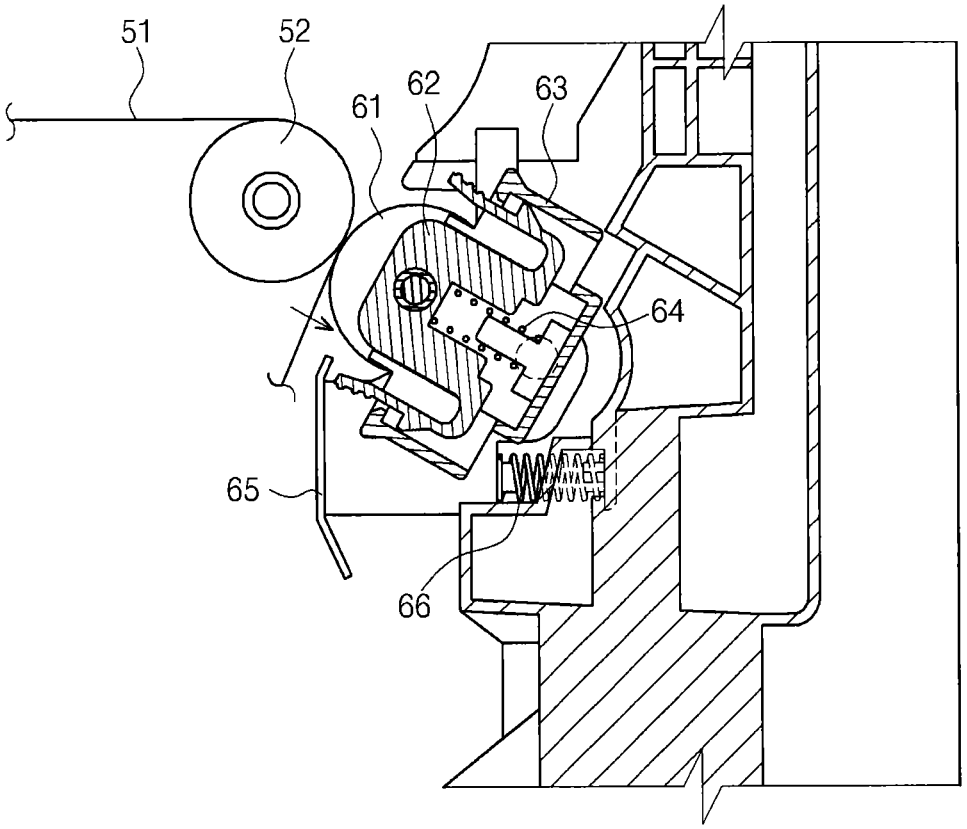
FIG. 5 is a cross sectional view illustrating an installation structure of a transfer roller of a second transfer unit of the image forming apparatus in accordance with the embodiment of the present disclosure.

Referring to FIG. 4, the second transfer unit 60 includes the second transfer roller 61 disposed opposite the driving roller 52 while interposing the transfer belt 51 therebetween to transfer a visible image of the transfer belt 51 to a printing medium, two hinge members 62 rotatably supporting both ends of a shaft of the second transfer roller 62, a pair of moving guides 63 having accommodating portions 63*a*, respectively, at which the hinge members 62 are movably installed, respectively, and a moving spring 64 installed at the moving guide 63 to elastically support the hinge member 62. Accordingly, referring to FIG. 5, the hinge member 62 is elastically supported by the moving spring 64, and thus the second transfer roller 61, while interposing the transfer belt 52 therebetween, is pressed against the driving roller 52 and comes into close contact with the driving roller 52 by a restoring force of the moving spring 64.

As described above, the second transfer unit 60 is movably installed at the side cover 11, and as for the position of the second transfer unit 60, the second transfer unit 60 is accommodated in the body 10 as the side cover 11 closes the opening 10*c* while rotating, and in this process, the position of the second transfer unit 60 is restricted so that the second transfer roller 62 is precisely pressed against the driving roller 52.

The side cover 11 includes a pair of guide brackets 11*a* disposed at both sides of the second transfer unit 60, respectively, such that the second transfer unit 60 is movably installed between the pair of guide brackets 11*a*. Each of the guide brackets 11*a* includes a guide hole 11*b*, which has a width in upward/downward directions and a width in left/right directions that are larger than a width in upward/downward directions and a width in left/right directions of the second guide protrusion 60*b*, so that the inner end of the second guide protrusion 60*b* is movably installed at the guide hole 11*b*. A lower end portion of the guide hole 11*b* is provided in a V-shape, and when the inner end of the second guide protrusion 60*b* is positioned at the lower end portion of the guide hole 11*b*, the guide hole 11*a* supports the second guide protrusion 60*b*, so that the second transfer unit 60 is prevented from being moved.

As described above, for the restriction of the position of the second transfer unit 60, the plurality of guide protrusions 60*a* and 60*b* are provided at the both sides of the second transfer unit 60, and the guide members 14 and 15 corresponding to the guide protrusions 60*a* and 60*b* are disposed at the both sidewalls of the inside the body 10.

The guide protrusions 60*a* and 60*b* each have a cross section in a circular shape so as to be easily guided by the guide members 14 and 15. The guide members 14 and 15 include support portions 14*a* and 15*a*, to which the guide protrusions 60*a* and 60*b* are supported in an engagement manner, respectively, and guide portions 14*b* and 15*b* to guide the guide protrusions 60*a* and 60*b* to the support portions 14*a* and 15*a*.

Figure 6:
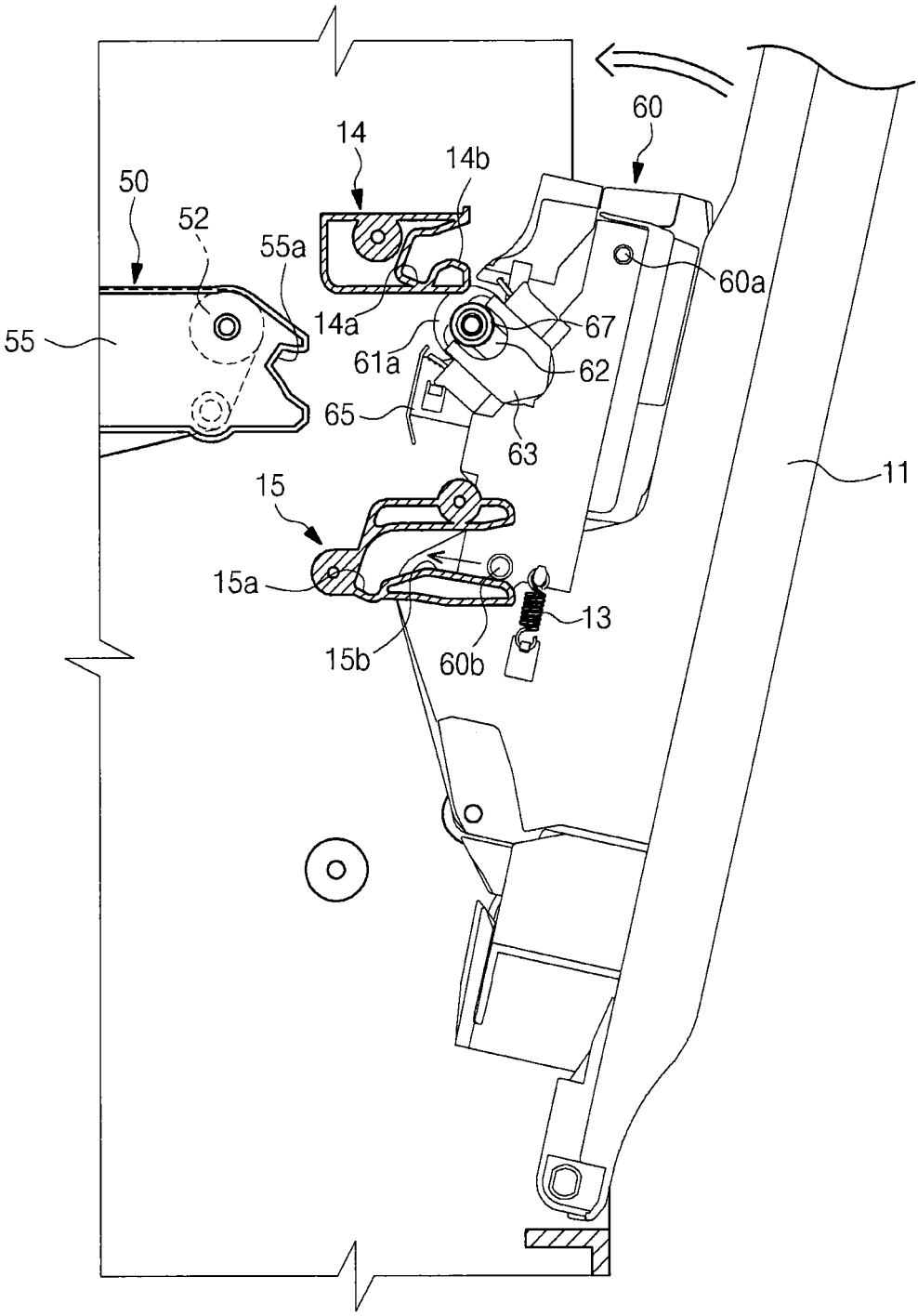
FIGS. 6 through 10 are side views showing an operation of opening/closing a side cover applied to the image forming apparatus in accordance with the embodiment of the present disclosure, and an operation of the second transfer unit according to the operation of the side cover.
Figure 7:
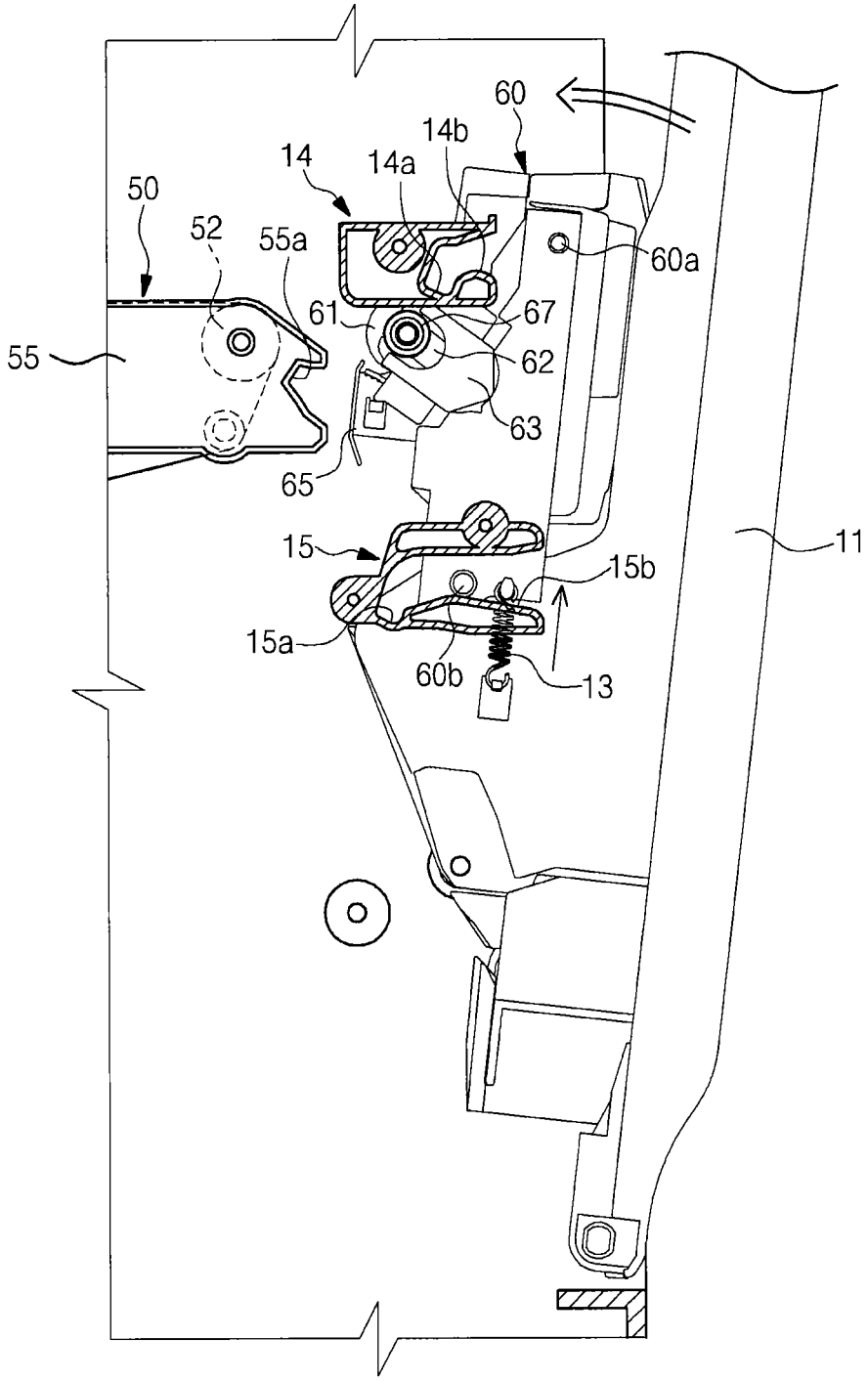
Figure 8:
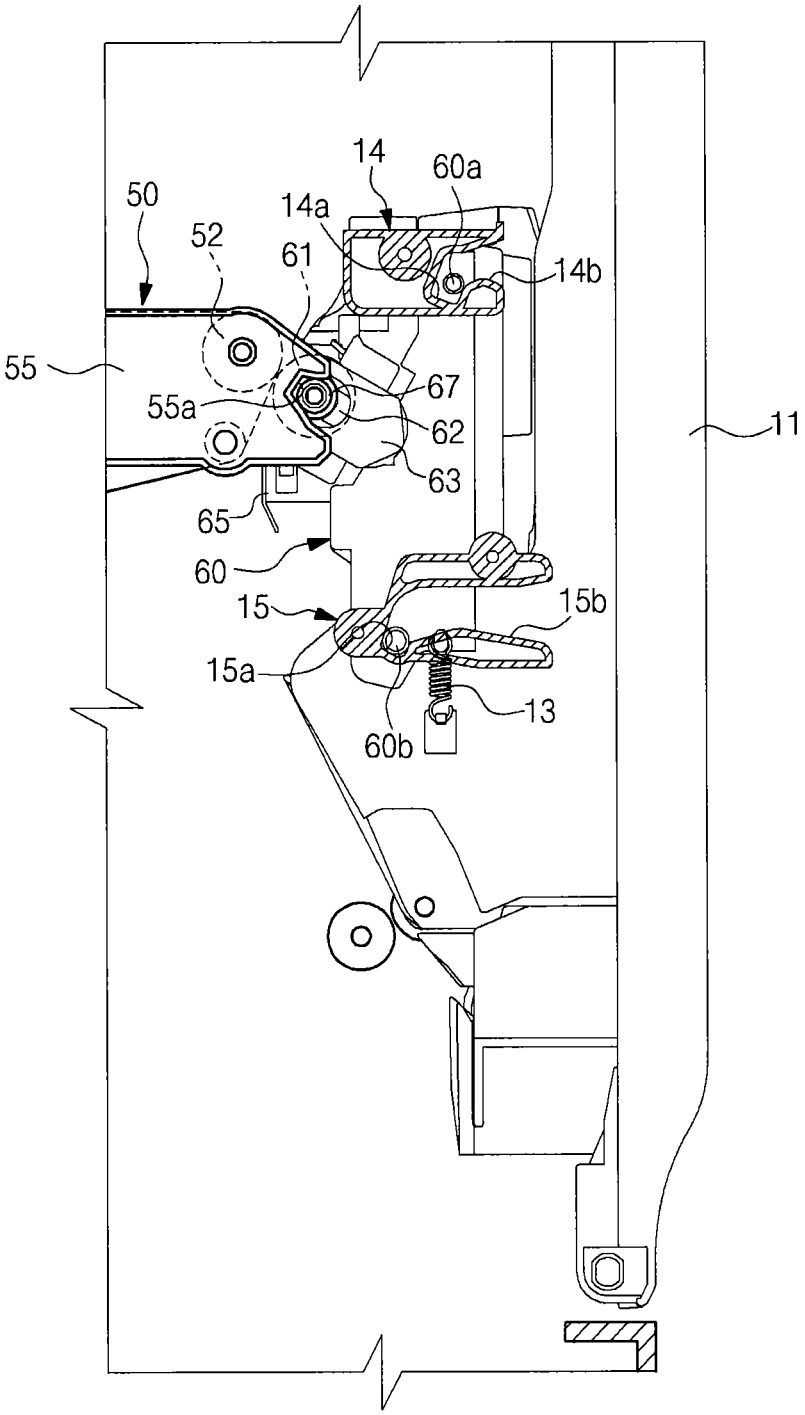

Referring to FIGS. 6 and 7, in a case when the opening 10*c* is closed by the side cover 11, the guide protrusions 60*a* and 60*b* move along the guide portions 14*b* and 15*b*, respectively, and the moving spring 13 is elastically deformed while the second transfer unit 60 moves by a predetermined distance upward with respect to the side cover 11. Referring to FIG. 8, the guide protrusions 60*a* and 60*b*, after being accommodated in the support portions 14*a* and 15*a*, are supported at the support portions 14*a* and 15*a* in an engaged manner by an elastic restoring force of the moving spring 13. At this time, the outer end of the first guide protrusion 60*a* is supported by the support portion 14*a* of the first guide member 14 at one side thereof, and the outer end of the second guide protrusion 60*b* is supported by the support portion 15*a* of the second guide member 15 at one side thereof and a lower side thereof.

Figure 10:
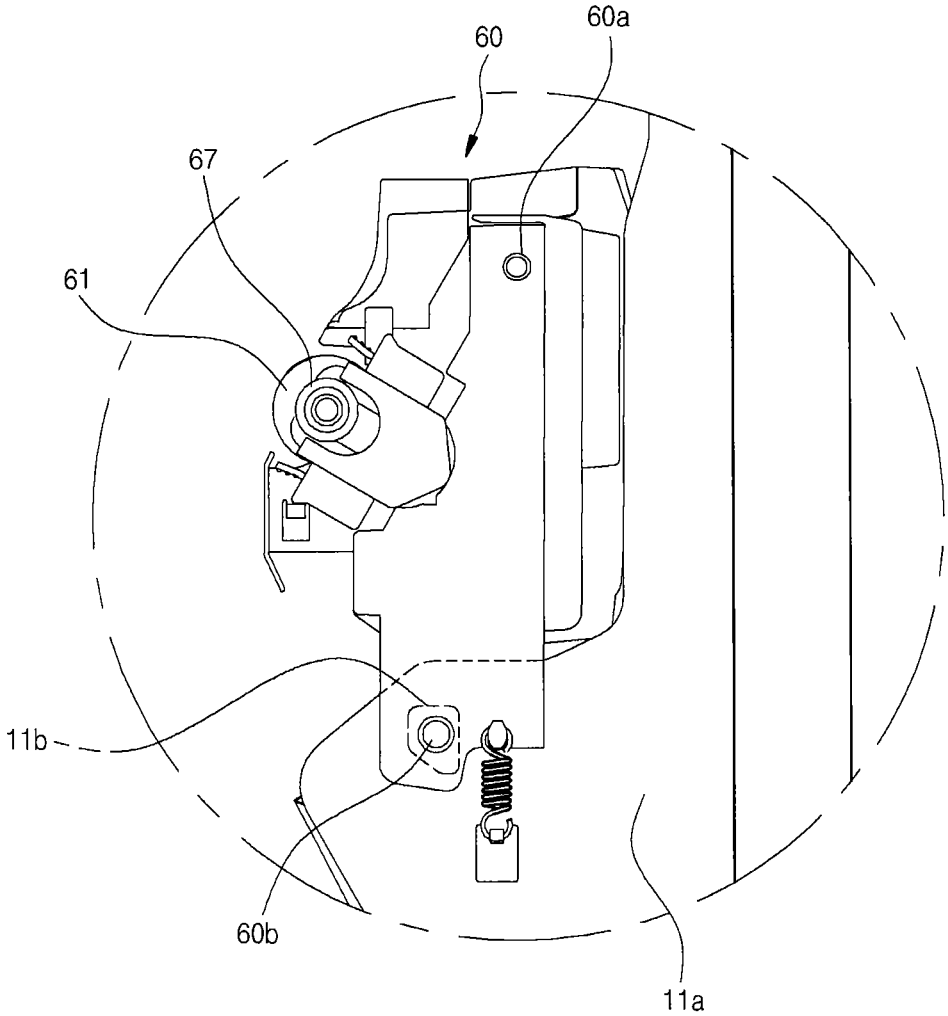

As described above, since the guide protrusions 60*a* and 60*b* are supported at the support portions 14*a* and 15*a* of the guide members 14 and 15, respectively, and in a case where the second transfer roller 61 is pressed against the driving roller 52, the reaction force acting on the second transfer unit 60 comes to act on the both sidewalls of the inside of the body 10 through the guide members 14 and 15. Accordingly, the reaction force is not transferred to the side cover 11, or even if transferred, the amount of the reaction force transferred is very small. In particular, the inner end of the second guide protrusion 60*b*, in a case where the second transfer unit 60 is moved upward, is moved upward so as to be spaced apart from an inner surface of the guide hole 11*b* as shown in FIG. 10. In this state, a force is not transmitted between through the second guide protrusion 60*b* and the guide hole 11*a*. Accordingly, even if a reaction force is applied from the first transfer unit 50 to the second transfer unit 60, the force is not transferred to the side cover 11 but to the second transfer unit 60.

In addition, in order for the second transfer roller 61 to be further supported in a precise manner at the driving roller 52, bearings 67 are installed at both ends of the shaft of the second transfer roller 61, respectively, and the transfer belt frame 55 is provided at one end thereof with a restriction groove 554*a* having a V-shape to restrict the position of the bearing 67.

In the structure as such, in a state when the second transfer roller 61 is supported at the driving roller 52, a reaction force acts on the guide protrusions 60*a* and 60*b*. At this time, in order to open the side cover 11, a user needs to apply a force larger than the reaction force acting on the guide protrusions 60*a* and 60*b* such that the guide protrusions 60*a* and 60*b* are separated from the guide members 14 and 15.

In order to open the side cover 11 with a smaller force, the second transfer unit 60, as shown in FIG. 4, includes a rotation bracket 65 allowing the second transfer roller 61 to rotate on a position deviated from the center of rotation of the second transfer roller 61, and a rotation spring 66 to elastically support the rotation bracket 65 such that the rotation bracket 65 is rotated in one direction.

The moving guides 63 are installed at both ends of the rotation bracket 65, respectively, and the rotation bracket 65 is rotatably installed at the second transfer unit 60 through a hinge protrusion 63*b*. The hinge protrusion 63*b* in accordance with the embodiment of the present disclosure extends as an integral body from the moving guide 63 installed at each side of the rotation bracket 65, and protrudes while passing through the rotation bracket 65, so that the rotation bracket 65 is rotatably installed at the second transfer unit 60.

Figure 9:
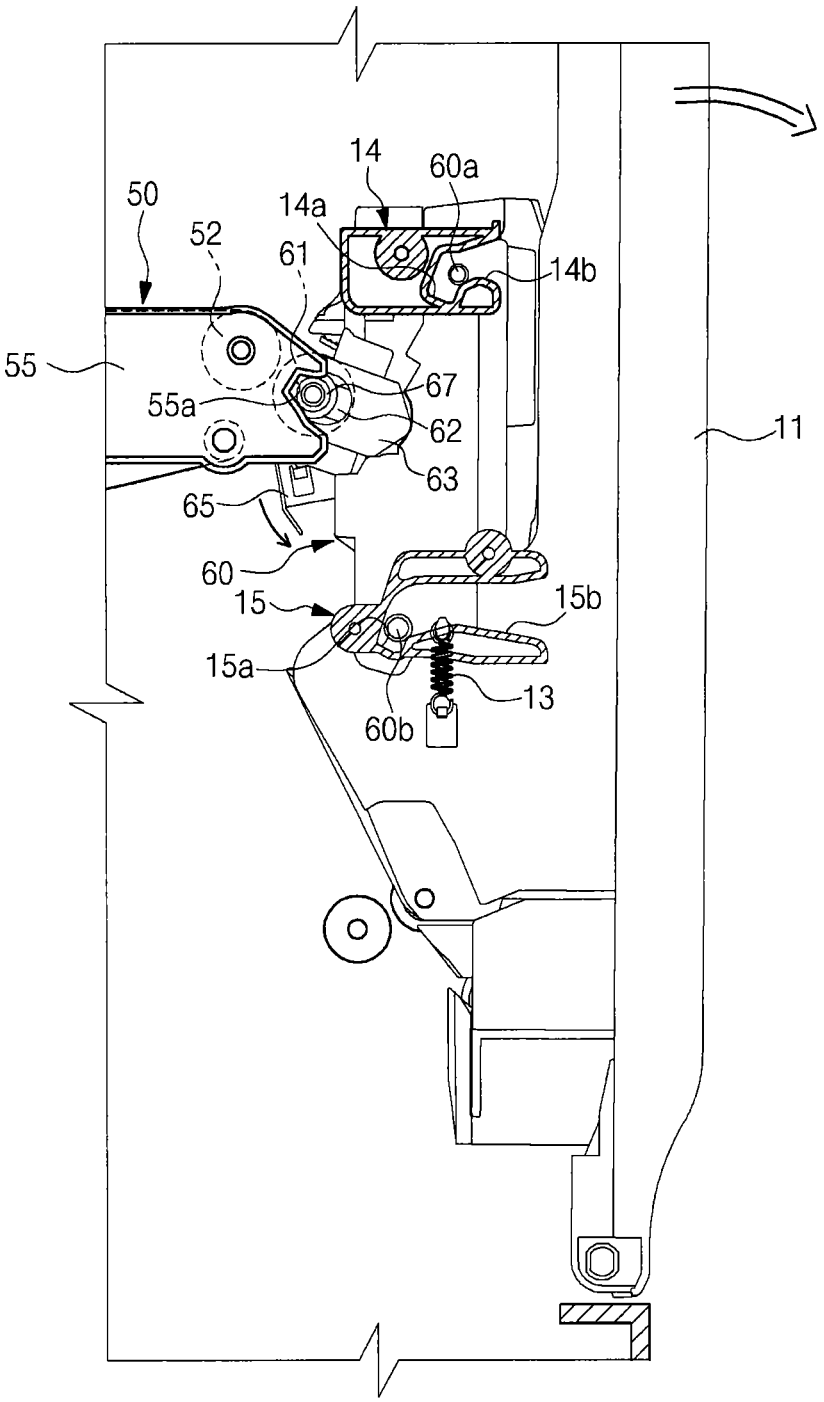

Accordingly, referring to FIG. 9, when the opening 10*c* is opened as the side cover 11 rotates, at an initial state of opening the side cover 11, the rotation spring 66 is elastically deformed by a reaction force acting on the second transfer roller 61, and the rotation bracket 65 rotates with respect to the side cover 11, while the moving spring 64 is elastically deformed and the two hinge members 62 move to an inner side of the moving guide 63, and thus the bearing 67 is separated from the restriction groove 55*a*. Accordingly, the reaction force transferred to the guide protrusions 60*a* and 60*b* is temporarily reduced, so the guide protrusions 60*a* and 60*b* are separated from the support portions 14*a* and 15*a* of the guide members 14 and 15 with a smaller force. Accordingly, the opening 10*c* is opened by rotating the side cover 11 with a smaller force.

On the contrary, when the side cover 11 is closed, the rotation spring 66 is elastically deformed and the rotation bracket 65 is rotated with respect to the side cover 11, and the moving spring 64 is elastically deformed and the two hinge members 62 are moved to an inner side of the moving guide 63 and thus the bearing 67 moves toward an inner side of the restriction groove 55*a*. Accordingly, the bearing 67 enters to the inner side of the restriction groove 55*a* with a small force.

In the above described embodiment of the present disclosure, the side cover 11 is rotatably installed so as to open/close the opening 10*c* while rotating, but the present disclosure is not limited thereto. The present disclose may be applied to an image forming apparatus having a side cover installed to open/close an opening while linearly moving.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An image forming apparatus comprising:

a body having an opening at one side thereof;

a side cover rotatably installed to open and close the opening while rotating;

a plurality of developing units each comprising a photoconductor to develop an electrostatic latent image to a visible image through a toner;

a first transfer unit disposed at an inside the body such that the visible image of the photoconductor is transferred to the first transfer unit; and a second transfer unit movably installed at the side cover to transfer the visible image of the first transfer unit to a printing medium, wherein the second transfer unit comprises a plurality of guide protrusions provided at both sides of the second transfer unit to perform a position restriction, and the body comprises a plurality of guide members provided at both sidewalls at the inside the body to support the plurality of guide protrusions installed at the second transfer unit, so that a force transferred from the first transfer unit to the second transfer unit is prevented from being transferred to the side cover.

2. The image forming apparatus of claim 1, wherein the first transfer unit comprises a transfer belt to be supplied with a toner from the plurality of developing units, a plurality of first transfer rollers each disposed opposite to the photoconductor while interposing the transfer belt therebetween, and a driving roller and a driven roller disposed at both sides of an inside the transfer belt, respectively, the second transfer unit comprises a second transfer roller disposed opposite the driving roller while interposing the transfer belt therebetween, and the guide member guides the guide protrusion such that the second transfer roller is pressed against the driving roller while interposing the transfer belt therebetween.

3. The image forming apparatus of claim 2, wherein the first transfer unit comprises a transfer belt frame at which both end portions of each of the plurality of first transfer rollers, both end portions of the driving roller, and both end portions of the driven roller are rotatably installed, bearings are installed at both end portions of the shaft of the second transfer roller, respectively, and a restriction groove is formed at the transfer belt frame to restrict a position of the bearing.

4. The image forming apparatus of claim 3, wherein the restriction groove is provided in a shape of V.

5. The image forming apparatus of claim 1, wherein the guide member comprises a support portion at which the guide protrusion is supported in an engagement manner, and a guide portion to guide the guide protrusion to the support portion.

6. The image forming apparatus of claim 1, wherein the guide protrusion comprises a first guide protrusion disposed at an upper side of the second transfer unit, and a second guide protrusion disposed at a lower side of the second transfer unit, and the guide member comprises a first guide member disposed at an upper side of the both sidewalls of the inside the body, and a second guide member disposed at a lower side of the both sidewalls of the inside the body.

7. The image forming apparatus of claim 6, wherein the side cover comprises a pair of guide brackets disposed at both sides of the second transfer unit, respectively, such that the second transfer unit is movably installed, a pair of second guide protrusions among the plurality of guide protrusions each has an outer end extending toward lateral sides of the side cover and guided by the second guide member, and an inner end extending toward the guide bracket, and the pair of guide brackets each comprises a guide hole to which the inner end of the second guide protrusion is movably installed.

8. The image forming apparatus of claim 1, further comprising a movable spring allowing the second transfer unit to be elastically supported against the side cover.

9. The image forming apparatus of claim 1, wherein the second transfer unit comprises a rotation bracket, to which the second transfer roller is rotatably installed so as to rotate on a position deviated from a center of rotation of the second transfer roller; and a rotation spring elastically supporting the rotation bracket.

10. The image forming apparatus of claim 9, wherein the second transfer unit comprises a pair of hinge members rotatably supporting both ends of a shaft of the second transfer roller, a pair of moving guides installed at both sides of the rotation bracket, respectively, such that the hinge member is movable toward the driving roller, and a moving spring allowing the hinge member to be elastically supported against the moving guide, and the second transfer roller is installed at the rotation bracket through the hinge member and the moving guide.

11. An image forming apparatus comprising:

a body having an opening;

a side cover configured to open and close the opening;

a plurality of developing units each comprising a photoconductor to develop an electrostatic latent image to a visible image through a toner;

a first transfer unit disposed at an inside the body such that the visible image of the photoconductor is transferred to the first transfer unit; and a second transfer unit installed at the side cover to transfer the visible image of the first transfer unit to a printing medium, wherein the second transfer unit comprises a plurality of guide protrusions provided at both sides of the second transfer unit to perform a position restriction, and the body comprises a plurality of guide members provided at both sidewalls of the inside the body to support the plurality of guide protrusions.

12. The image forming apparatus of claim 11, wherein the second transfer unit is movably installed at the side cover.

13. The image forming apparatus of claim 12, wherein the second transfer unit further comprises a moving spring allowing the second transfer unit to be elastically supported against the side cover.

14. The image forming apparatus of claim 11, wherein the guide member comprises a support portion at which the guide protrusion is supported in an engagement manner, and a guide portion to guide the guide protrusion to the support portion.

* * * * *